US007270512B2

(12) United States Patent
Sullivan et al.

(10) Patent No.: US 7,270,512 B2
(45) Date of Patent: Sep. 18, 2007

(54) STACKED STEAMPATH AND GROOVED BUCKET WHEELS FOR STEAM TURBINES

(75) Inventors: Christopher Walter Sullivan, Ballston Spa, NY (US); Robert James Bracken, Niskayuna, NY (US); Jeffrey Robert Simkins, Rensselaer, NY (US); Stephen Roger Swan, Clifton Park, NY (US); David Orus Fitts, Ballston Spa, NY (US); Ronald Wayne Korzun, Clifton Park, NY (US); John Thomas Murphy, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 98 days.

(21) Appl. No.: 11/209,624

(22) Filed: Aug. 24, 2005

(65) Prior Publication Data

US 2007/0048130 A1 Mar. 1, 2007

(51) Int. Cl.
*F01D 9/00* (2006.01)

(52) U.S. Cl. ..... 415/199.5; 416/215; 416/212 R

(58) Field of Classification Search ..... 415/199.5, 415/198.1; 416/215, 218, 212 R, 212 A, 416/889, 889.2, 464; 29/889, 889.2, 464
See application file for complete search history.

(56) References Cited

U.S. PATENT DOCUMENTS 4,086,690 A * 5/1978 Bernasconi ..... 29/889.2
4,859,149 A * 8/1989 McClain ..... 416/215
5,984,633 A * 11/1999 Bachinger et al. ..... 415/209.2
6,152,697 A * 11/2000 Konishi et al. ..... 416/213 R
6,438,837 B1 * 8/2002 Berry et al. ..... 29/889

* cited by examiner

*Primary Examiner*—Edward K. Look
*Assistant Examiner*—Dwayne J White
(74) *Attorney, Agent, or Firm*—Nixon & Vanderhye, PC

(57) ABSTRACT

The steampath for a steam turbine includes stacked stator rings each mounting inwardly directed nozzles and stacked rotor wheels each mounting outwardly directed buckets mounting blades. By alternately stacking the stator rings and rotor wheels, the nozzles and buckets of the various stages are interdigitated to form a steampath. Each bucket includes a blade and a root received in a generally complementary shaped groove on a wheel.

17 Claims, 8 Drawing Sheets

STACKED STEAMPATH AND GROOVED BUCKET WHEELS FOR STEAM TURBINES

BACKGROUND OF THE INVENTION

The present invention relates to a stacked steampath having both rotary and fixed components formed of wheels and rings respectively about a common axis. The present invention also relates to a dovetail bucket wheel for the stacked steam turbine.

Current integral cover reaction buckets are formed of large quantities of individual buckets that are assembled onto a machine rotor forging. Similarly, current nozzle stages are formed of large quantities of nozzles assembled onto a stator casing. The time and cost associated with rotor forgings and stator casings, rotor and stator machining, bucket and nozzle stock material, bucket and nozzle machining, and rotor and stator assembly add significantly to the costs to the steampath. Accordingly, there is a need to reduce the time and cost of manufacturing and assembling steampath hardware without impacting the integrity of the overall steam turbine design.

BRIEF DESCRIPTION OF THE INVENTION

In a preferred embodiment of the present invention there is provided a steampath for a steam turbine comprising: a plurality of stacked wheels having a plurality of blades extending outwardly of the wheels and about a common axis; a plurality of stacked rings having a plurality of nozzles extending inwardly of the rings and about the common axis; the wheels and rings alternating along said axis forming respective stages of the steam turbine and defining the steampath.

In a further preferred embodiment of the present invention there is provided a steampath for a steam turbine comprising: a plurality of stacked wheels about a common axis with each wheel having a peripheral groove and a plurality of buckets each having a blade and a root, said root and said groove being shaped to retain the root of each bucket within the groove, and a plurality of rings mounting nozzles and alternating with the stacked wheels about the common axis defining with said buckets the steampath.

Figure 1:
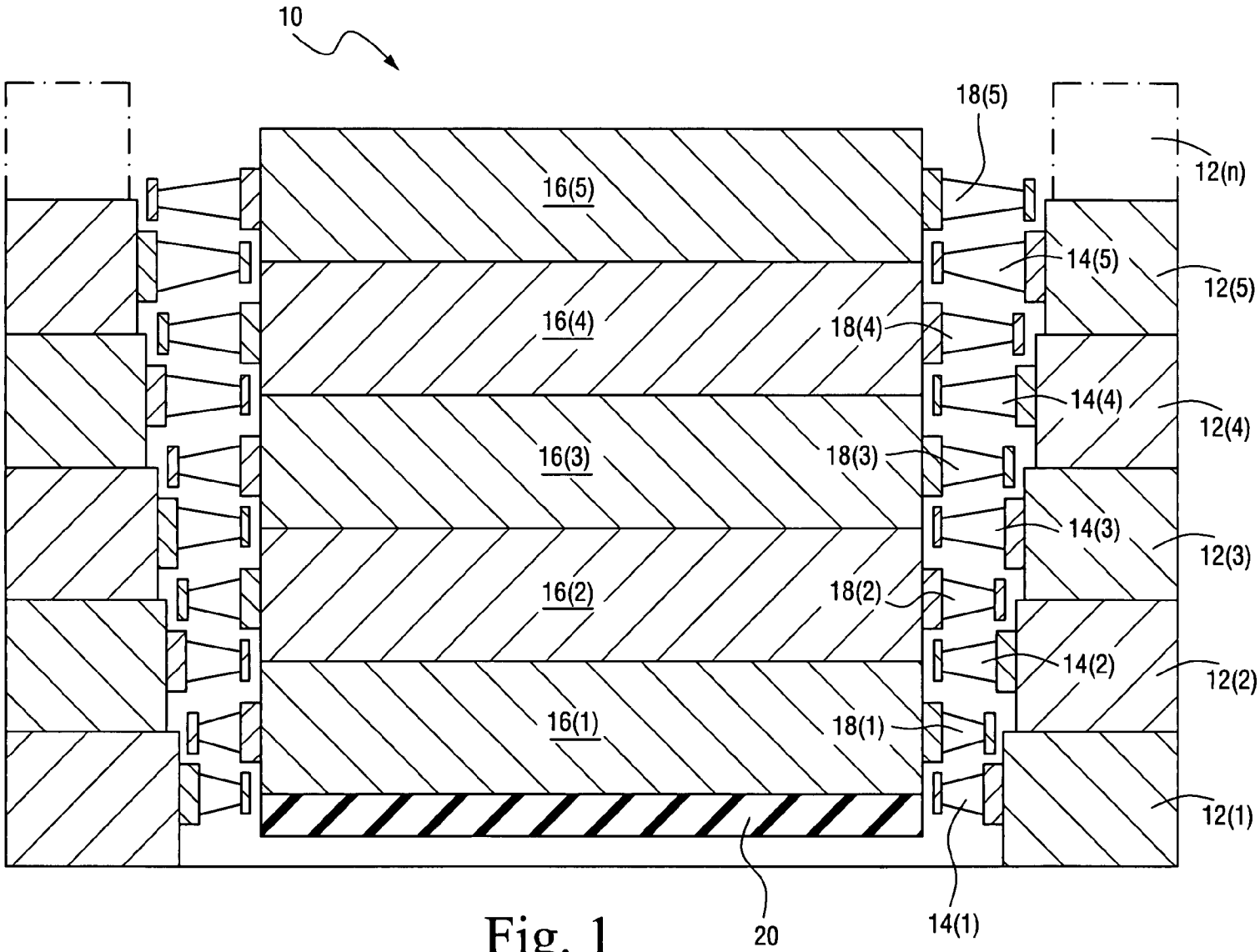
FIG. 1 is a schematic representation of a formation of a steampath in accordance with a preferred aspect of the present invention.

Referring now to the drawings, particularly to FIG. 1, there is illustrated a steampath generally designated 10 by alternate vertical stacking of stator rings or wheels carrying nozzles and rotor wheels carrying buckets. It will be appreciated that the stacking of the steampath components need not be accomplished in a vertical orientation of the steampath but can be accomplished in a horizontal orientation or other orientations. Particularly, the steam turbine stator is formed of a series of stacked stator rings or wheels 12. Each stator ring or wheel 12 carries a plurality of circumferentially inwardly extending nozzles 14 at axial spaced locations along the steampath 10. For example, the first stage stator ring 12(1) carries nozzles 14(1), a second stage nozzle ring 12(2) carries nozzles 14(2), a third stage nozzle ring 12(3) carries third stage nozzles 14(3), a fourth stage nozzle ring 12(4) carries fourth stage nozzles 14(4), and a fifth stage nozzle ring 12(5) carries fifth stage nozzle 14(5). Additional nozzle stages represented by the dash lines 12(*n*) are provided.

Alternating with the nozzle rings 12 are the rotor wheels 16 mounting the rotor buckets. For example, and in referring to FIG. 1, the first stage rotor wheel 16(1) mounts first stage buckets 18(1), a second stage rotor wheel 16(2) mounts second stage buckets 18(2), a third stage bucket wheel 16(3) mounts third stage buckets 18(3), a fourth stage rotor wheel 16(4) mounts fourth stage buckets 18(4) and a fifth stage rotor wheel 16(5) mounts a fifth stage buckets 18(5). Additional rotor wheels and buckets are provided to correspond to any additional stages. It will be appreciated that the inwardly directed nozzles 14 and the outwardly directed buckets 18 interdigitate with one another to form the various steampath stages. As illustrated in FIG. 1, an inlet spacer wheel 20 is provided adjacent the steampath inlet secured to the initial rotor wheel 16(1). Additionally, axial face compression seals are provided between the adjacent stator rings 12 and also between the adjacent rotor wheels 16.

As illustrated, the steam path is built up to multiple stages by alternate placement of the stator rings 12 and rotor wheels 16 about a common axis. The various rings and wheels of the stationary and rotating components of the steampath are provided with hardware such that the rings and/or wheels cannot be assembled in the wrong location or direction or out of the predetermined order. For example, the stator rings 12 may have axial projections and recesses on adjacent axial faces which must align with one another to ensure that the adjacent rings correspond to successive stages of the steampath. Similarly, the wheels 16 may have projections and recesses to insure their accurate alignment in the predetermined order of the various stages.

Figure 5:
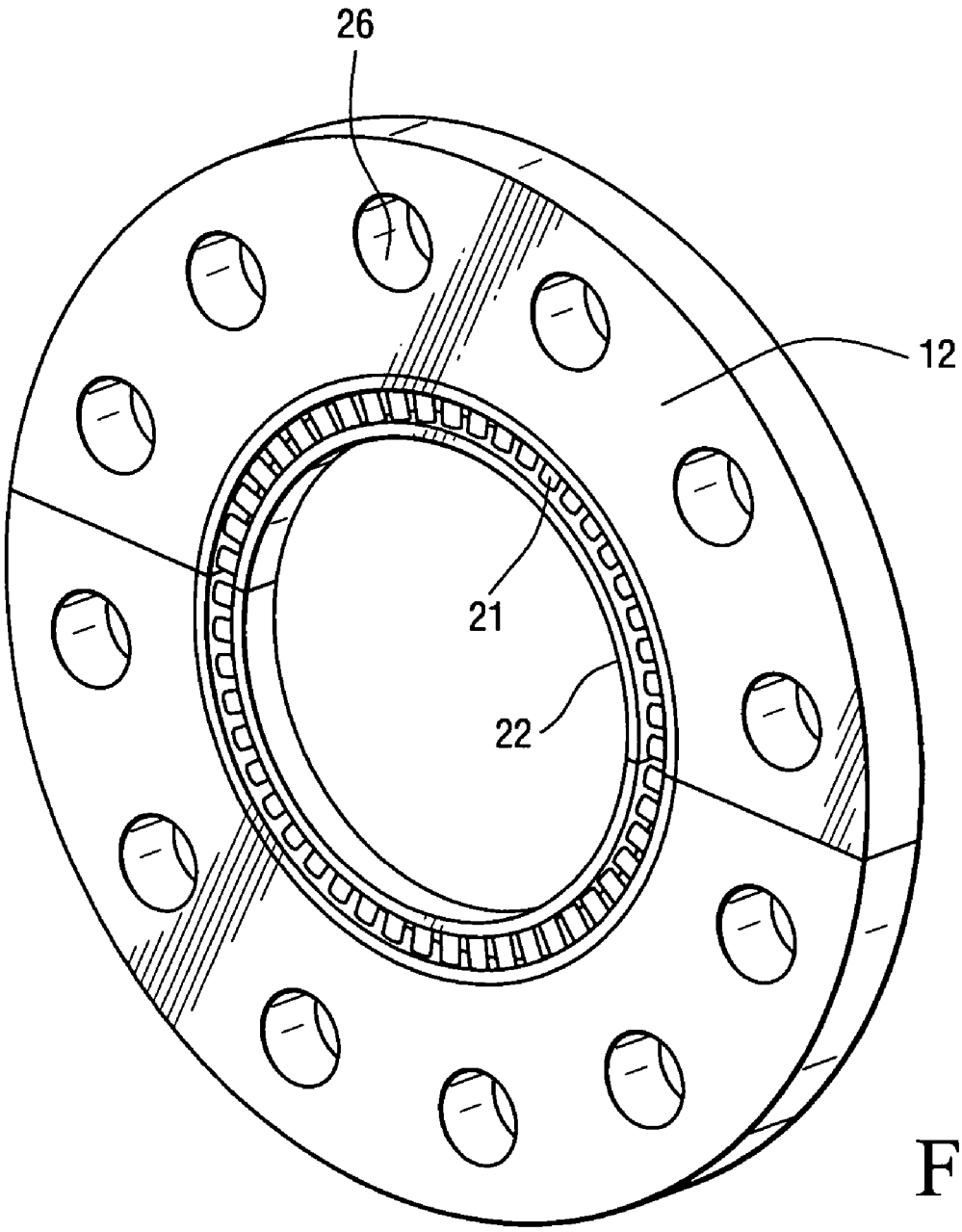
FIG. 5 is a perspective view of an integrated nozzle ring or wheel.
Figure 6:
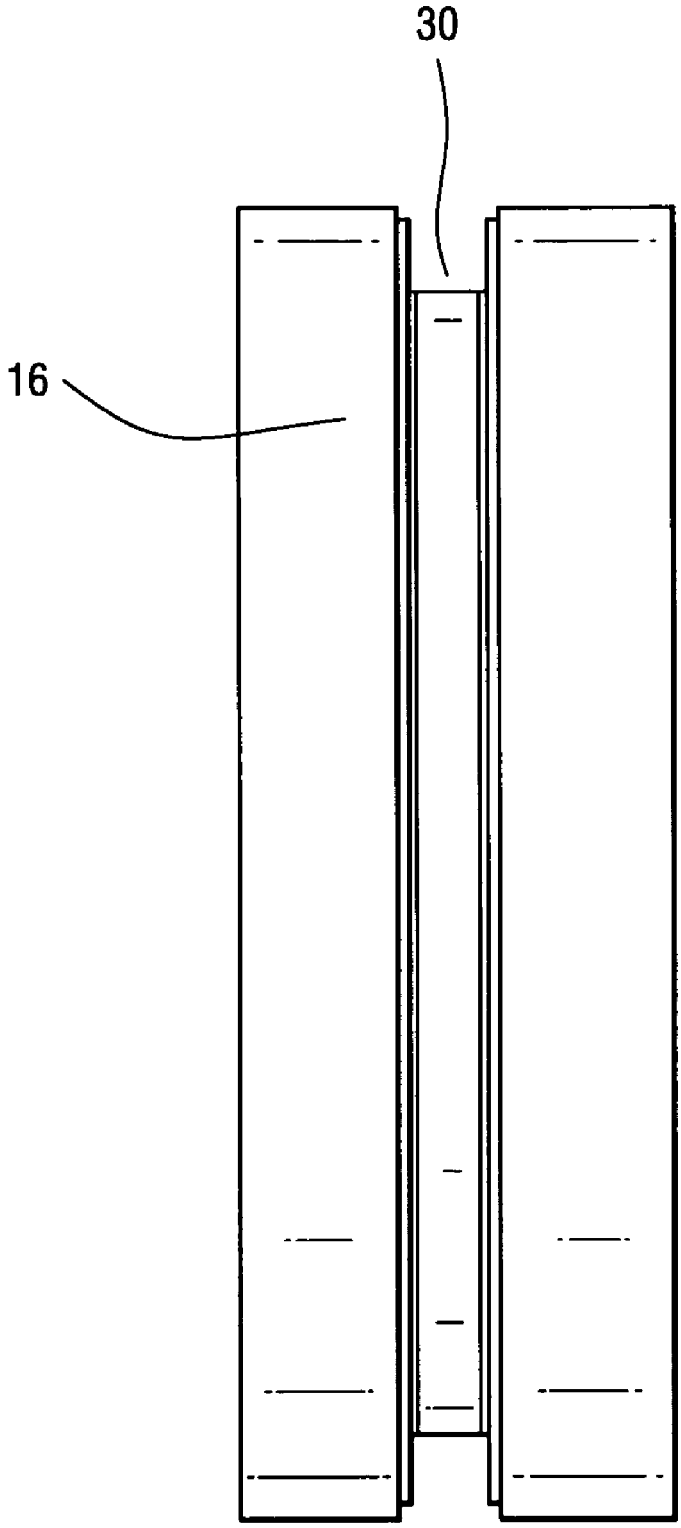
FIG. 6 is a side elevational view of an individual rotor wheel illustrating the dovetail about its periphery.
Figure 7:
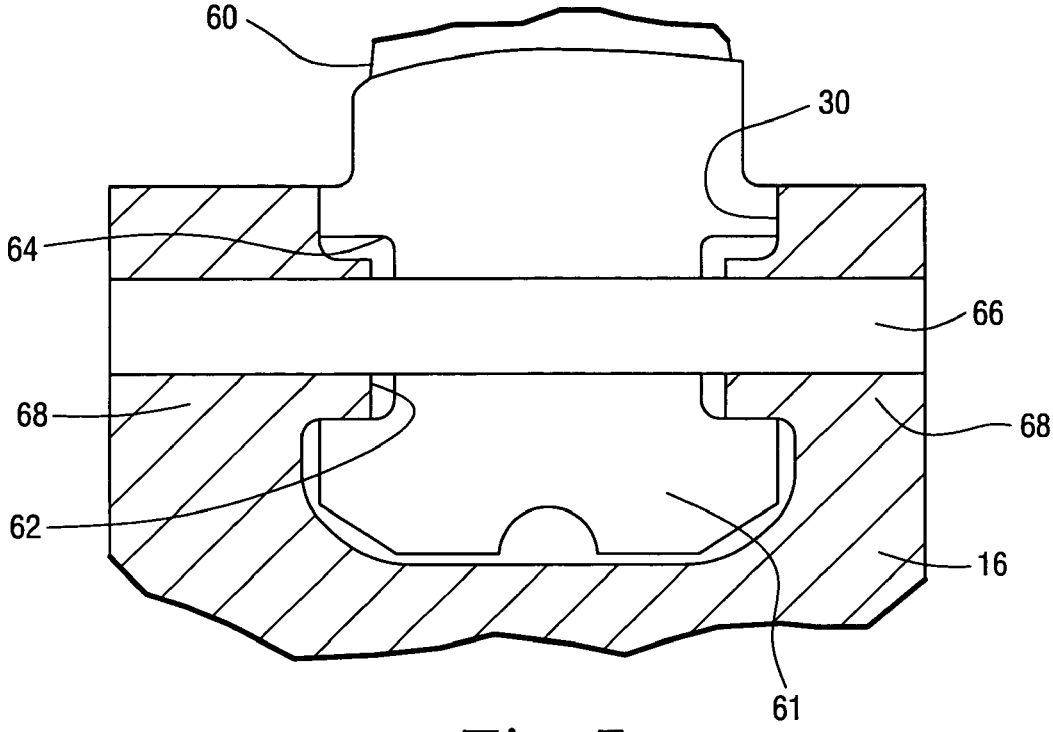
FIGS. 7-9 illustrate various forms of securing the closure bucket on the rotor wheel.

Referring to FIG. 5, each of the stator rings 12 may be formed of a complete annulus. The nozzles i.e., the blades 21 may be integrally formed on the wheel by machining together with their inner cover or diaphragm 22. Alternatively, the interior periphery of the stator ring 12 may be grooved by machining to receive one or more nozzles in a stacked circumferential array thereof, together with their covers. As a further alternative, the stator ring may be formed in a pair of 1800 segments and secured one to the other at a midline, for example by bolting flanges adjacent the midline to one another. As illustrated, a plurality of circumferentially spaced holes 26 are formed through the stator rings to receive retention hardware whereby the stator rings may be axially secured to one another. For example, the retention hardware may include axial bolts, studs, threaded rods, or similar devices hereafter collectively called studs. The studs 28 (FIG. 24) are passed through the aligned holes 26 of the various stator rings and have threaded ends for application of nuts 27. Alternatively, the stacked rings may be welded to one another. $Similarly, and referring to FIG. 3, each of the rotor wheels 16 preferably includes a grooved outer periphery 30 (FIG. 6) for receiving individual buckets as described below. The buckets are preferably stacked one against the other about the periphery of the wheel with each bucket having a bucket cover 32. Each wheel 16 includes a plurality of circumferentially spaced holes 34 for receiving studs similarly as with respect to the stator rings. Studs are received through the aligned holes 34 to secure the rotor rings axially adjacent to one another with compression seals, not shown, therebetween. As in the case of the stator rings, the rotor wheels may, alternatively, be welded to one another.

Figure 3:
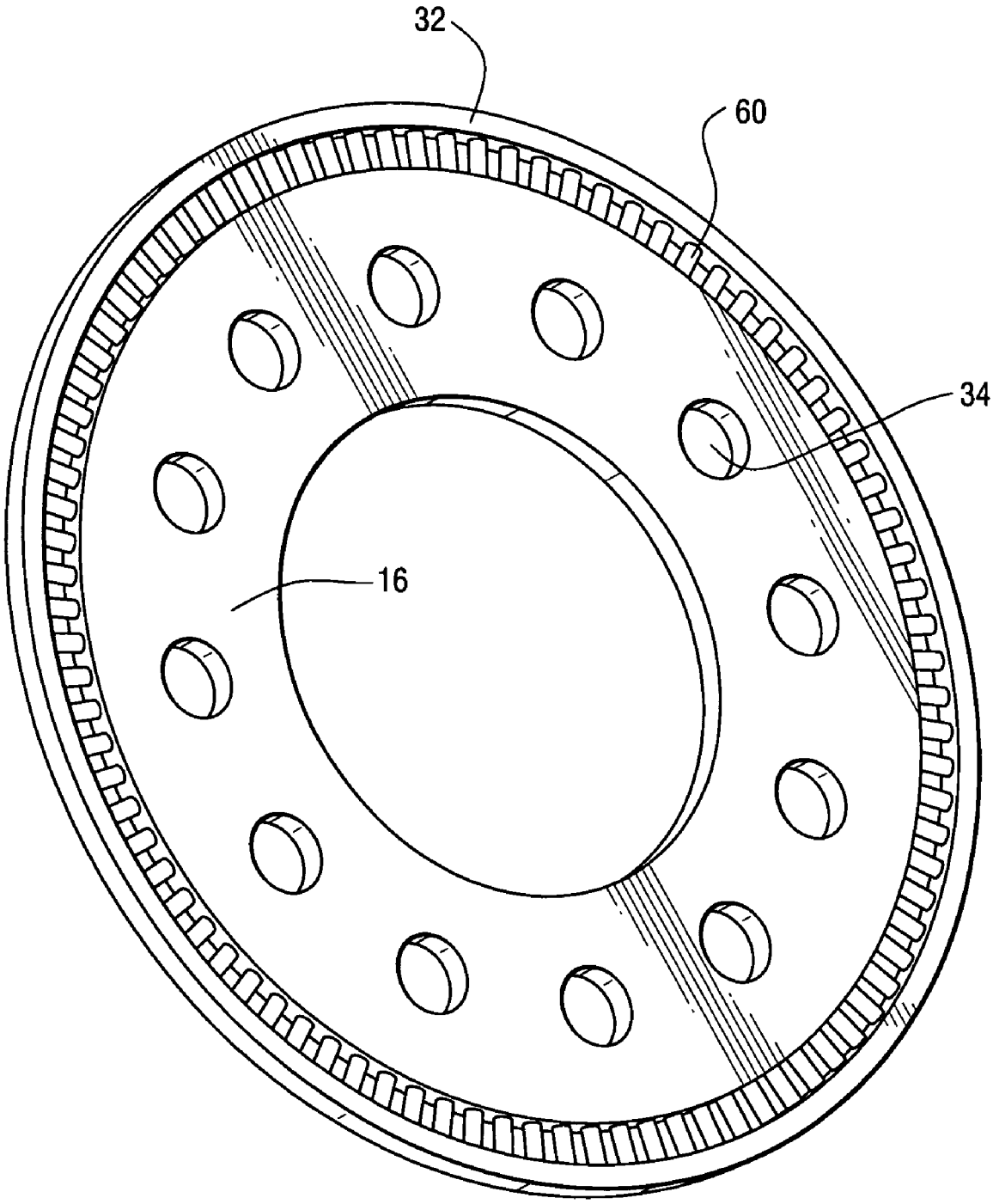
FIG. 3 is a perspective view of a wheel for the rotor mounting a plurality of buckets.

Similarly, and referring to FIG. 3, each of the rotor wheels 16 preferably includes a grooved outer periphery 30 (FIG. 6) for receiving individual buckets as described below. The buckets are preferably stacked one against the other about the periphery of the wheel with each bucket having a bucket cover 32. Each wheel 16 includes a plurality of circumferentially spaced holes 34 for receiving studs similarly as with respect to the stator rings. Studs are received through the aligned holes 34 to secure the rotor rings axially adjacent to one another with compression seals, not shown, therebetween.

The studs which interconnect the stator rings 12 and the rotor wheels 16 need not necessarily extend the entire length of the steampath. The various stages may comprise sub-assemblies with each sub-assembly containing a predetermined number of stages. For example, six sub-assemblies of five stages per sub-assembly in a thirty stage steampath may be provided. The studs may extend only through the stages of each group or may terminate within the initial stator ring or wheel of an adjacent group to secure the sub-assemblies of stages to one another. A particular benefit of assembling the stator rings individually and rotor wheels individually facilitates the service and repair of the various stages. Moreover, the capacity to provide an individual stator ring or rotor wheel at each stage location, enables different materials to be used from location to location, i.e., from stage to stage. Thus, certain stages may use less costly materials without degradation of the overall integrity of the steampath. For example, the inlet stage of the steampath may be formed of material necessary to withstand the high temperature and pressure of steam at the steam inlet and which material may be costly. Subsequent stages, being exposed to lower temperatures and pressures may be formed of less costly material.

Figure 2:
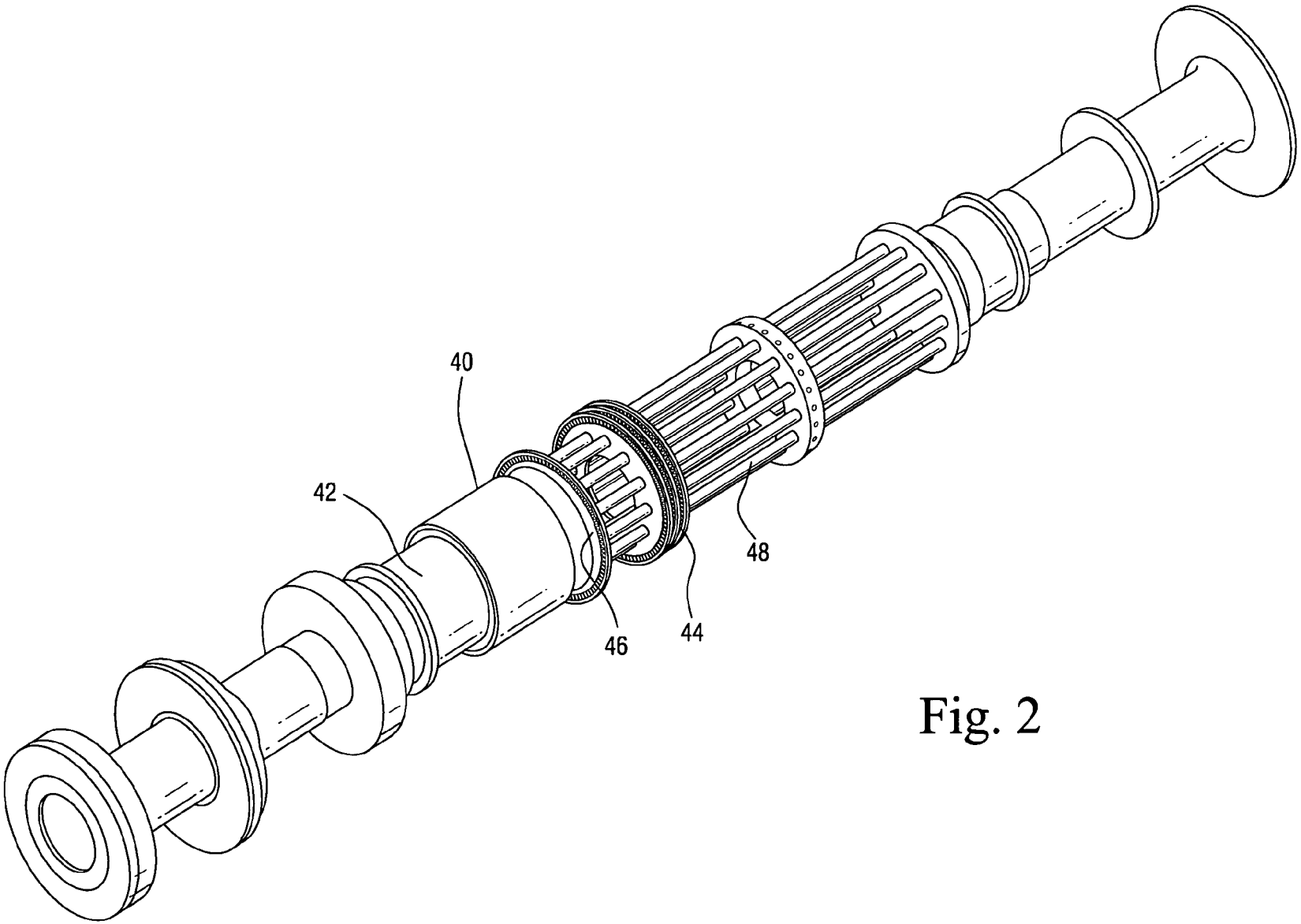
FIG. 2 is schematic illustration demonstrating a process for forming stacked wheels and buckets in a rotor.

Referring to FIG. 2, there is also illustrated a complete rotor 40 with end forgings 42 and intermediate stacked rotor wheel assembly 44 (a number of the wheels having been removed for clarity). The end forgings may include an end disk 46 to which the assembled rotor wheels may be secured using studs 48. Consequently, the intermediate portion of an otherwise integral elongated forging has been replaced by a rotor having an intermediate series of wheels 16 mounting buckets secured axially to one another forming the steampath.

Figure 4:
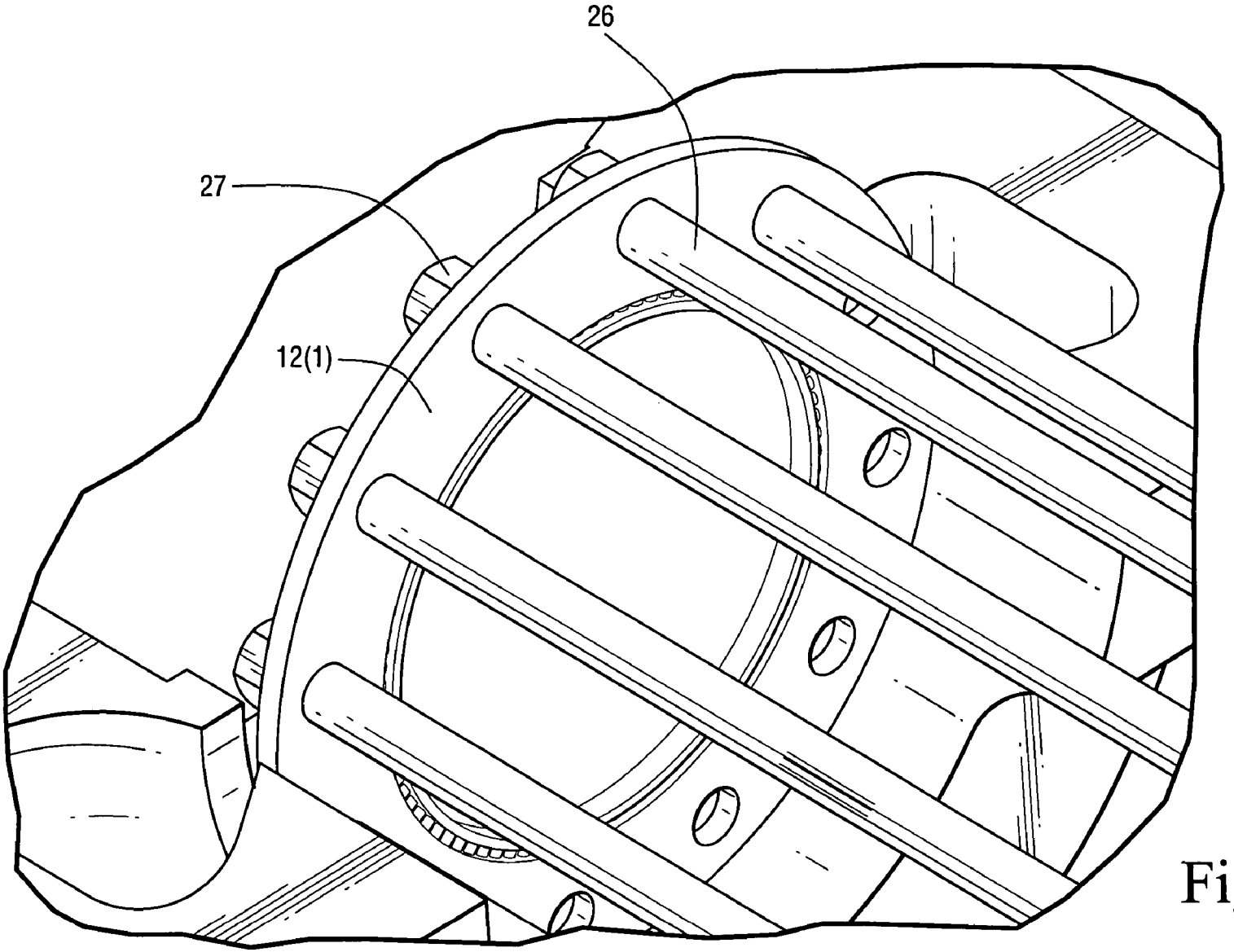
FIG. 4 is a perspective fragmentary view illustrating the formation of a stator.

Referring to FIG. 4, the first stage stator ring 12(1) is illustrated situate in an outer casing 50, in this instance part of a turbine inlet through which steam is provided for passage through the initial first stage and follow-on stages.

Figure 8:
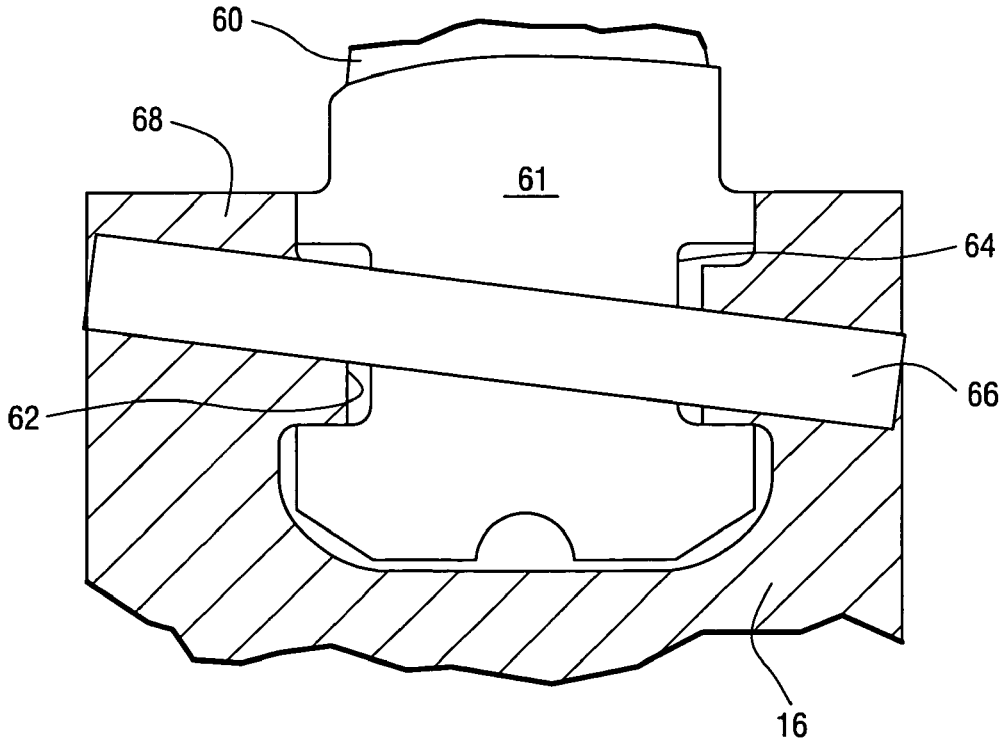
Figure 9:
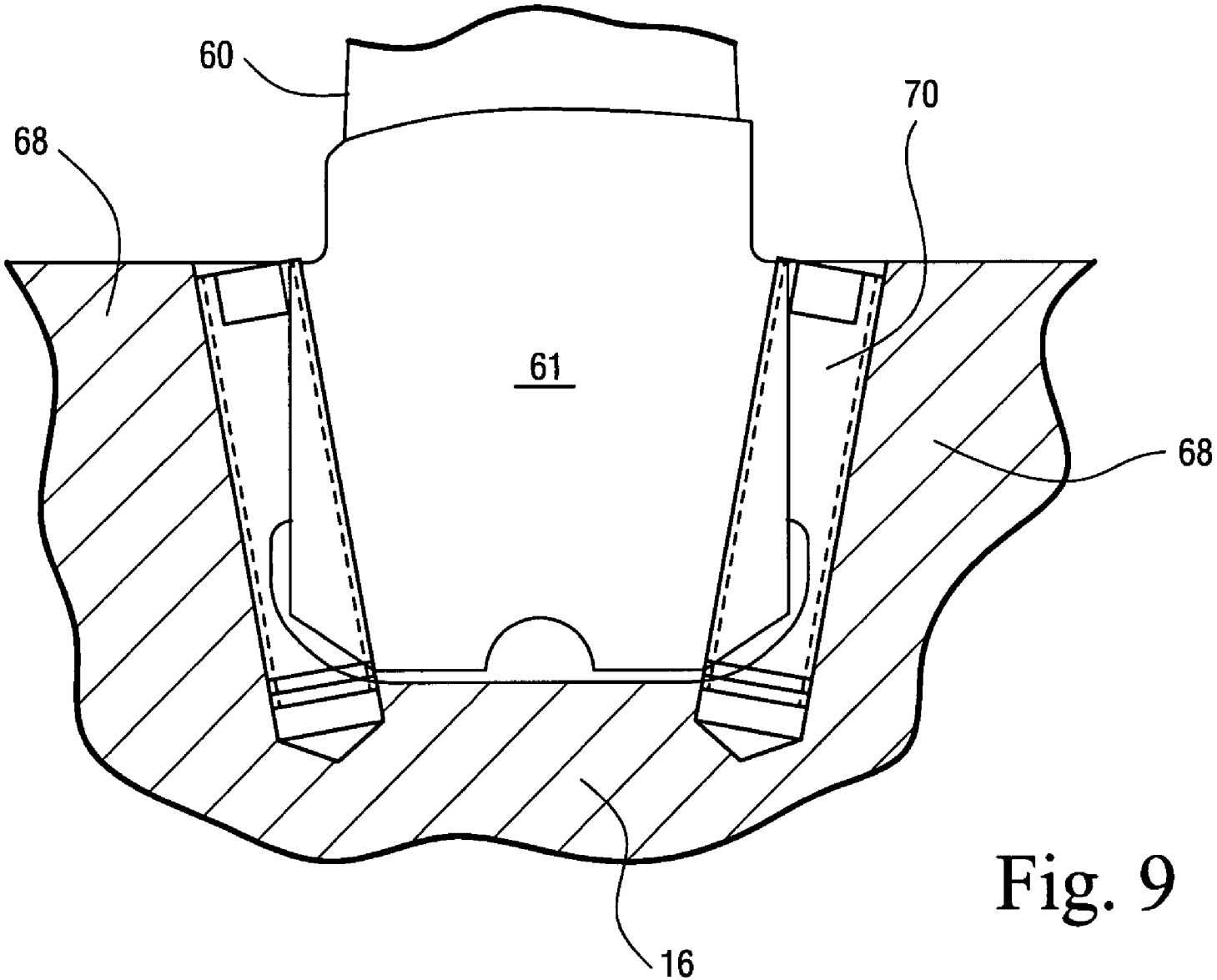

Referring to FIG. 6-9, each of the rotor wheels 16 may be formed with a peripheral groove 30 for cooperation with the root 61 of each bucket 60 to retain the bucket in the groove. For example the groove 30 may have a dovetail shape configuration 62 for receiving a generally complementary dovetail shape configuration 64 formed on the root of each bucket. The groove 30 also includes a circumferential entry and closure slot, enabling each of the buckets to be inserted in a general radial direction for alignment of the root 61 with the groove 30 and enabling the bucket 60 to be displaced about the periphery of the groove into a final position stacked against an adjacent bucket. When all of the buckets have been inserted into the groove 30, a final closure bucket is received in the slot. The closure bucket may have the same or different cross-sectional configuration than the groove. To retain the closure bucket on the wheel, an axially extending shear pin, 66 may pass through the margins 68 of the wheel and groove 30 and through a hole formed axially through the root 61 of the bucket 60. Alternatively, the shear pin 66 may be canted relative to the axis of the wheel as illustrated in FIG. 8. In FIG. 9, grub screws 70 are applied passing through the margins 68 of the wheel 16 defining the groove 30 and through the margins of the root 61 of the bucket 60, thereby securing the closure bucket in final position in the groove.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A steampath for a steam turbine comprising:

a plurality of stacked wheels having a plurality of blades extending outwardly of the wheels and about a common axis;

a plurality of stacked rings having a plurality of nozzles extending inwardly of the rings and about the common axis;

including a plurality of aligned openings through the rings at spaced locations about the rings and a plurality of studs extending through the openings through the rings to secure said rings to one another; and the wheels and rings alternating along said axis forming respective stages of the steam turbine and defining the steampath.

2. A steampath according to claim 1, including a plurality of aligned openings through the wheels at spaced locations about the wheels and a plurality of studs extending through the openings to secure the wheels to one another.

3. A steampath according to claim 1, wherein the blades and nozzles interdigitate with one another.

4. A steampath according to claim 1, wherein the blades are formed integrally with each wheel.

5. A steampath according to claim 1, wherein the wheels have a peripheral groove, a plurality of buckets each mounting a blade and a root, said groove being shaped to retain the root of each bucket within the groove.

6. A steampath according to claim 1, wherein the steampath includes a steam inlet end and a steam outlet end, the materials of the wheels forming stages at the inlet and outlet ends being different than one another.

7. A steampath according to claim 1, including a steam inlet end and a steam outlet end, the materials of the rings forming stages at the inlet and outlet ends being different than one another.

8. A steampath according to claim 1, wherein said rings in assembly form a stator for the steam turbine.

9. A steampath for a steam turbine comprising:

a plurality of stacked wheels having a plurality of blades extending outwardly of the wheels and about a common axis;

a plurality of stacked rings having a plurality of nozzles extending inwardly of the rings and about the common axis;

including a plurality of aligned openings through the rings at spaced locations about the rings and a plurality of studs extending through the openings through the rings to secure the rings to one another;

the wheels and rings alternating along said axis forming respective stages of the steam turbine and defining the steampath; and wherein said rings are welded to one another to form a stator for the steam turbine.

10. A steampath according to claim 1, wherein said wheels are welded to one another to form a rotor for the steam turbine.

11. A steampath for a steam turbine comprising:

a plurality of stacked wheels about a common axis with each wheel having a peripheral groove and a plurality of buckets each having a blade and a root, said root and said groove being shaped to retain the root of each bucket within the groove, a shear pin extending through margins of the groove and the root of a closure bucket to secure the closure bucket to the wheel;

and a plurality of stacked rings mounting nozzles and alternating with the stacked wheels about the common axis defining with said buckets the steampath.

12. A steampath according to claim 11, wherein said shear pin extends generally in an axial direction.

13. A steampath according to claim 11, wherein said shear pin extends at an angle canted to the common axis.

14. A steampath for a steam turbine comprising:

a plurality of stacked wheels about a common axis with each wheel having a peripheral groove and a plurality of buckets each having a blade and a root, said root and said groove being shaped to retain the root of each bucket within the groove, and a plurality of rings mounting nozzles and alternating with the stacked wheels about the common axis defining with said buckets the steampath; and including at least one grub screw for securing the closure and bucket and wheel to one another.

15. A steampath according to claim 11, wherein said plurality of rings form a stator for said turbine.

16. A steampath according to claim 11, wherein said plurality of rings are welded together to form a stator for said turbine.

17. A steampath according to claim 11, wherein said plurality of wheels are welded together to form a rotor for said turbine.

* * * * *

UNITED STATES PATENT AND TRADEMARK OFFICE

CERTIFICATE OF CORRECTION

PATENT NO. : 7,270,512 B2
APPLICATION NO. : 11/209624
DATED : September 18, 2007
INVENTOR(S) : Christopher Sullivan et al.

It is certified that error appears in the above-identified patent and that said Letters Patent is hereby corrected as shown below:

At column 2 line 52 change the numeral “1800” to --180°--

Delete the entire remainder of the paragraph beginning with “$Similarly” in column 2 line 63 and ending in column 3 line 8.

At column 3 line 19 after “tween.” insert the sentence --As in the case of the stator rings, the rotor wheels may, alternatively, be welded to one another.--

Signed and Sealed this

Fourth Day of December, 2007

JON W. DUDAS
*Director of the United States Patent and Trademark Office*